US005290184A

United States Patent [19]

Balogh et al.

[11] Patent Number: 5,290,184

[45] Date of Patent: Mar. 1, 1994

[54] ILLUMINATED FLYING DISK HAVING BALANCED HOUSING FOR SPLIT CIRCUITRY

[75] Inventors: John M. Balogh, Morton Grove; Donald V. Kress, Orland Park; Michael Toler, Chicago, all of Ill.

[73] Assignee: Imagination Factory, Inc., Orland Park, Ill.

[21] Appl. No.: 974,984

[22] Filed: Nov. 12, 1992

[51] Int. Cl.[5] ..... A63H 27/00; A63H 1/24; A63H 33/26

[52] U.S. Cl. ..... 446/47; 446/242; 446/485

[58] Field of Search ..... 446/46, 47, 242, 484, 446/485, 48, 34, 232, 242, 255; 273/424, 425, 428

[56] References Cited

U.S. PATENT DOCUMENTS

| | | | |
|---|---|---|---|
| D. 183,626 | 9/1958 | Morrison . | |
| D. 242,057 | 10/1976 | Sun . | |
| D. 260,786 | 9/1981 | Chaklos . | |
| D. 312,103 | 11/1990 | Lenox . | |
| 2,011,813 | 8/1935 | Heekin | 446/47 |
| 3,359,678 | 12/1967 | Headrick . | |
| 3,720,018 | 3/1973 | Peterson et al. . | |
| 3,724,122 | 4/1973 | Gillespie, Sr. . | |
| 3,786,246 | 1/1974 | Johnson et al. . | |
| 3,798,834 | 3/1974 | Samuel | 446/47 |
| 3,812,614 | 5/1974 | Harrington . | |
| 3,855,728 | 12/1974 | Hynds . | |
| 3,948,523 | 4/1976 | Michael . | |
| 4,080,753 | 3/1978 | Hiner et al. . | |
| 4,086,723 | 5/1978 | Strawick . | |
| 4,132,031 | 1/1979 | Psyras . | |
| 4,134,229 | 1/1979 | Lehman . | |
| 4,135,324 | 1/1979 | Miller et al. . | |
| 4,145,839 | 3/1979 | Sampietro . | |
| 4,205,484 | 6/1980 | Kovac et al. . | |
| 4,212,131 | 7/1980 | Ross, Jr. . | |
| 4,216,611 | 8/1980 | Psyras . | |
| 4,248,010 | 2/1981 | Fox | 273/424 X |
| 4,254,575 | 3/1981 | Gould . | |
| 4,255,895 | 3/1981 | LaBrecque . | |
| 4,301,616 | 11/1981 | Gudgel | 446/47 |
| 4,307,538 | 12/1981 | Moffitt . | |
| 4,431,196 | 2/1984 | Kutnyak . | |
| 4,435,917 | 3/1984 | Lee . | |
| 4,515,570 | 5/1985 | Beltran . | |
| 4,563,160 | 1/1986 | Lee | 446/47 |
| 4,568,297 | 2/1986 | Dunipace . | |
| 4,607,850 | 8/1986 | O'Riley . | |
| 4,681,553 | 7/1987 | Rodarte . | |
| 4,778,428 | 10/1988 | Wield . | |
| 4,846,749 | 7/1989 | Petko . | |
| 4,856,793 | 8/1989 | Hannifin . | |
| 4,869,699 | 9/1989 | Plambeck et al. . | |
| 4,929,212 | 5/1990 | Li | 446/46 X |
| 4,940,441 | 7/1990 | Novinsky . | |
| 5,032,098 | 7/1991 | Balogh et al. . | |
| 5,049,107 | 9/1991 | De Nittis | 446/484 X |
| 5,125,866 | 6/1992 | Arad et al. | 446/484 X |

*Primary Examiner*—David N. Muir
*Attorney, Agent, or Firm*—Patula & Associates

[57] ABSTRACT

A flying disc with two lights located on or near the disk's perimeter, with two symmetrically opposed housings on the underside of the disk near the disk's outmost edge. The two housings store the batteries and the electrical components for illuminating the disk. The housings are placed on opposite sides of the disk, so that the bulk of the disk's weight is on the disk's outside edge. Aerodynamic stability in a flying disk is optimum when the bulk of the disk's weight is distributed on it's outside edge. Thus, the present invention has greater stability when set in rotational motion than existing disks which house electronic components and batteries in the center.

20 Claims, 3 Drawing Sheets

ILLUMINATED FLYING DISK HAVING BALANCED HOUSING FOR SPLIT CIRCUITRY

FIELD OF THE INVENTION

This invention teaches a novel illuminated flying toy disk, typically used in recreational games.

BACKGROUND OF THE INVENTION

Numerous illuminated flying disks are known in the art, but none offer the novel, symmetrically opposed housings which significantly improve the flying characteristics of the disk over existing illuminated disks found in the prior art. For example, U.S. Pat. No. 3,798,834 to Samuel, and U.S. Pat. No. 4,929,212 to Li, teach centrifugally actuated illumination devices for flying toys, but the exposed, unaerodynamic configuration of the associated hardware of each illumination device alters the flight associated hardware of each illumination device alters the flight characteristics of the disk. Furthermore, the associated illumination hardware of Samuel is distributed toward the center of the disk. The present invention has recessed, aerodynamically shaped housings to cover the control circuitry and power supply which are located at the outer edges of the disk. Placing the housings at the outer edge of the disk promotes stablity during the disks flight. These special aerodynamic housings account for the exceptional flying characteristics of the present invention when same is set in rotational motion.

U.S. Pat. No. 3,812,614 to Harrington, U.S. Pat. No. 3,948,523 to Michael, U.S. Pat. No. 4,080,753 to Hiner et al., U.S. Pat. No. 4,086,723 to Strawick, U.S. Pat. No. 4,132,031 to Psyras, U.S. Pat. No. 4,134,229 to Lehman, U.S. Pat. No. 4,135,324 to Miller et al., U.S. Pat. No. 4,145,839 to Sampietro, U.S. Pat. No. 4,255,895 to LaBrecque, U.S. Pat. No. 4,301,616 to Gudgel, U.S. Pat. No. 4,307,538 to Moffitt, U.S. Pat. No. 4,431,196 to Kutnyak, U.S. Pat. No. 4,435,917 to Lee, U.S. Pat. No. 4,515,570 to Beltran, U.S. Pat. No. 4,563,160 to Lee, U.S. Pat. No. 4,607,850 to O'Riley, U.S. Pat. No. 4,681,553 to Rodarte, U.S. Pat. No. 4,778,428 to Wield, U.S. Pat. No. 4,846,749 to Petko, U.S. Pat. No. 4,869,699 to Plambeck et al., U.S. Pat. No. 4,940,441 to Novinsky, and U.S. Pat. No. DES 312,103 to Lenox all describe illuminated flying toys, but have the components and power sources of same located at the disk's center, or distribute the weight of the illumination hardware between the disk's center and the disk's outer edge, which alter the aerodynamics of the disk's flight when set in rotational motion. The present invention locates the power source and control circuitry on the outside edges of the disk's underside, which greatly improves the disk's stability during flight. U.S. Pat. No. 4,254,575 to Gould teaches a system of illuminating a saucer-like toy, but relies on chemiluminescence rather than ordinary, easily available batteries to illuminate the saucer.

Other flying toys, such as U.S. Pat. No. 3,724,122 to Gillespie, U.S. Pat. Nos. 3,855,728 to Hynds, 4,205,484 to Kovac et al., U.S. Pat. Nos. 4,212,131 to Ross, 4,216,611 to Psyras, and 4,568,297 to Dunipace do not show any method of illuminating the disk.

BRIEF SUMMARY OF THE INVENTION

A flying disc with two lights located on or near the disk's perimeter, with two symmetrically opposed housings on the underside of the disk near the disk's outmost edge. The two housings store the batteries and the electrical components for illuminating the disk. The housings are placed on opposite sides of the disk, so that the bulk of the disk's weight is on or near the disk's outside edge. Aerodynamic stability in a flying disk is optimum when the bulk of the disk's weight is distributed on it's outside edge. Thus, the present invention has greater stability when set in rotational motion than existing disks which house electronic components and batteries in the center.

The present invention also teaches a novel switch assembly which consists of a plastic sliding plate having an eyelet and a spring. The spring is placed around the body of the metal eyelet and captured by the plastic sliding plate. The spring keeps the eyelet in constant contact with the circuit board by applying upward tension on the flange of the eyelet. When the switch is moved to the "on" position, the eyelet is in contact with and bridges two etched contact pads on the circuit board. This movement closes and completes the electrical circuit, illuminating the disk's lights.

It is the principle object of this invention to teach a simple, aerodynamically efficient illuminated flying toy.

It is another object of the invention to show a novel method of electrically powering the illumination on a flying disk while maintaining excellent flight characteristics of same.

It is a further object of the invention to provide a new means of switching electrical power on and off for illumination circuitry on a flying disk.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DESCRIPTION OF THE EMBODIMENTS OF THE PRESENT INVENTION

Figure 1:
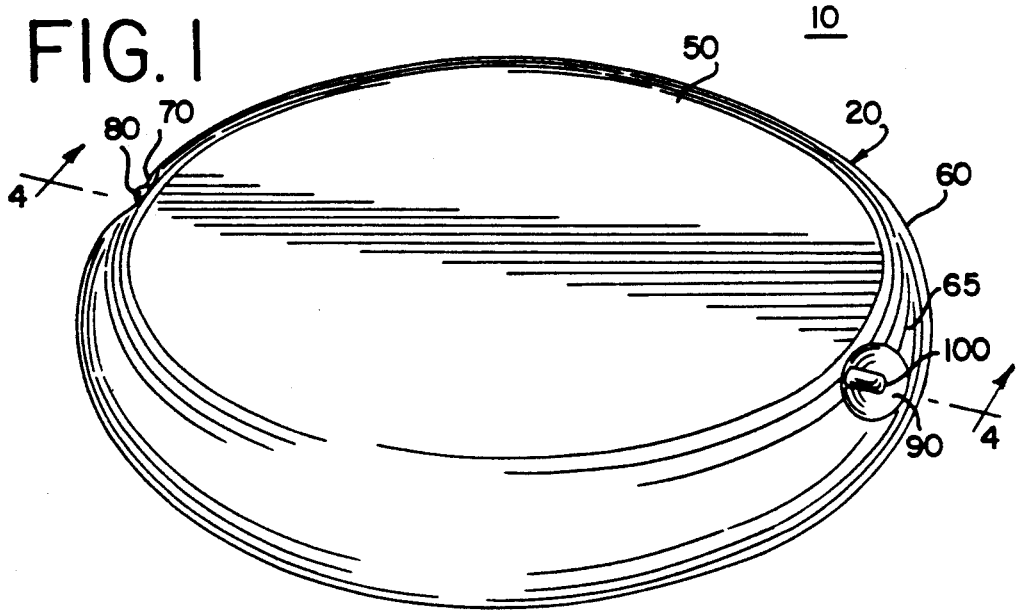
FIG. 1 is a perspective view of the preferred embodiment of the invention.

While the invention is susceptible of embodiment in many different forms there is shown in the drawings and will be described herein in detail, preferred and alternate embodiments of the invention. It should be understood, however, that the present disclosure is to be considered an exemplification of the principles of the invention and is not intended to limit the spirit and scope of the invention and/or claims of the embodiments illustrated.

Referring now to the drawings, FIG. 1 shows a perspective view of the preferred embodiment of the invention 10. The invention 10 consists of disk 20, having top 30, perimeter 50, and lip 60. On the outside surface 65 of lip 60 is first light emitter 80 in first recess 70, and second light emitter 100, in second recess 90. Disk 20 is aerodynamically shaped to provide lift when set in rotary motion by a user. In the preferred embodiment of the invention 10, disk 20 is preferably made of soft, resilient plastic, but could be made of other materials, such as hard plastic or hard synthetic rubber.

Figure 2:
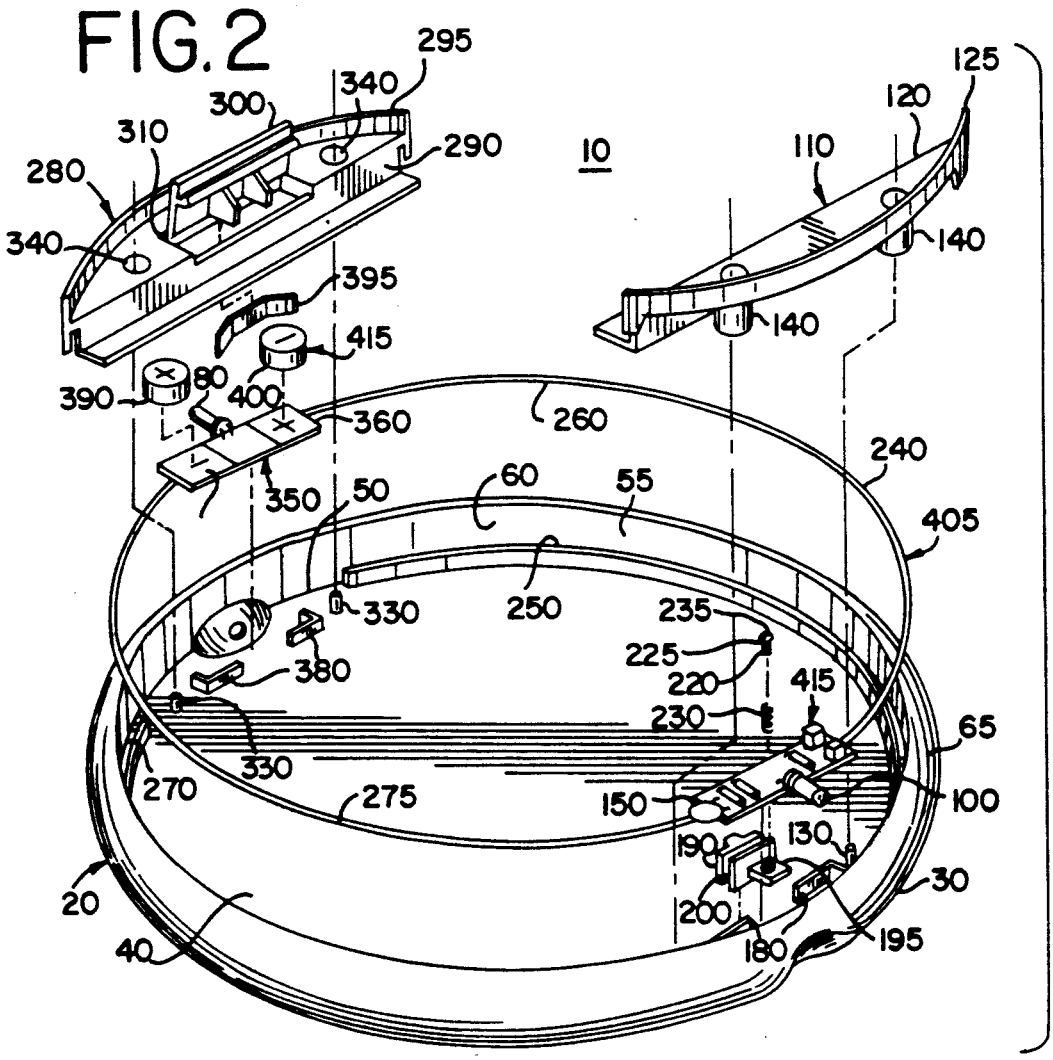
FIG. 2 is a bottom exploded view of the preferred embodiment of the invention of FIG. 1.

FIG. 2 shows a bottom exploded view of the preferred embodiment of the invention 10. The invention 10 consists of disk 20, having top 30, underside 40, perimeter 50, and lip 60. Lip 60 has inside surface 55, and outside surface 65. Also disposed on disk 20 are switch housing 110 and battery housing 280. The switch housing 110 and battery housing 280 have an areodynamic configuration and are disposed on opposing sides of the disk 20, making the disk 20 more stable during flight than other flying disks which have a weight placed in the center of the disk. The switch housing 110 and battery housing 280 may further have a rounded configuration and are small in size when compared to overall dimensions of the disk 20, which reduce aerodynamic drag and improve the flying characteristics of the disk 20. Battery housing 280 has battery housing cover 290, which has access 300, with living hinge 310, and spring conductor 395. Battery housing cover 290 may also have a simple slide-in cover (not shown) which can be removed and replaced to facilitate changing worn batteries. Battery housing cover 290 also has battery housing extension 295, which abuts inside surface 55 of lip 60 of disk 20, and prevents moisture from damaging control circuitry 405 by seeping onto components 415. Also seen in FIG. 2 are battery circuit board 350, battery circuit board supports 380, first battery 390 and second battery 400, first light emitter 80, battery housing posts 330, and battery housing post receptacles 340. First battery 390 and second battery 400, may but need not be, A-76 1.5 volt batteries. Light emitters 80 and 100 may be of standard size T-1¾" LEDS. Battery circuit board 350 has positive contact 360 and negative contact 370.

Switch housing 110 has switch housing cover 120 with switch housing receptacles 140, and switch housing extension 125. Switch housing extension 125 abuts inside surface 55 of lip 60 of disk 20, and prevents moisture from seeping into components 415, damaging control circuitry 405. Also shown is switch circuit board 150 with components 416, switch housing posts 130, second light emitter 100, switch circuit board supports 180, switch 190 having switch eyelet hole 195, eyelet 220 with body 225 and flange 235, eyelet spring 230, and switch guide 200. Also shown in FIG. 2 are first wire 240 and second wire 260, which can rest in first wire track 250, and third wire 275, which can rest in second wire track 270.

Figure 3:
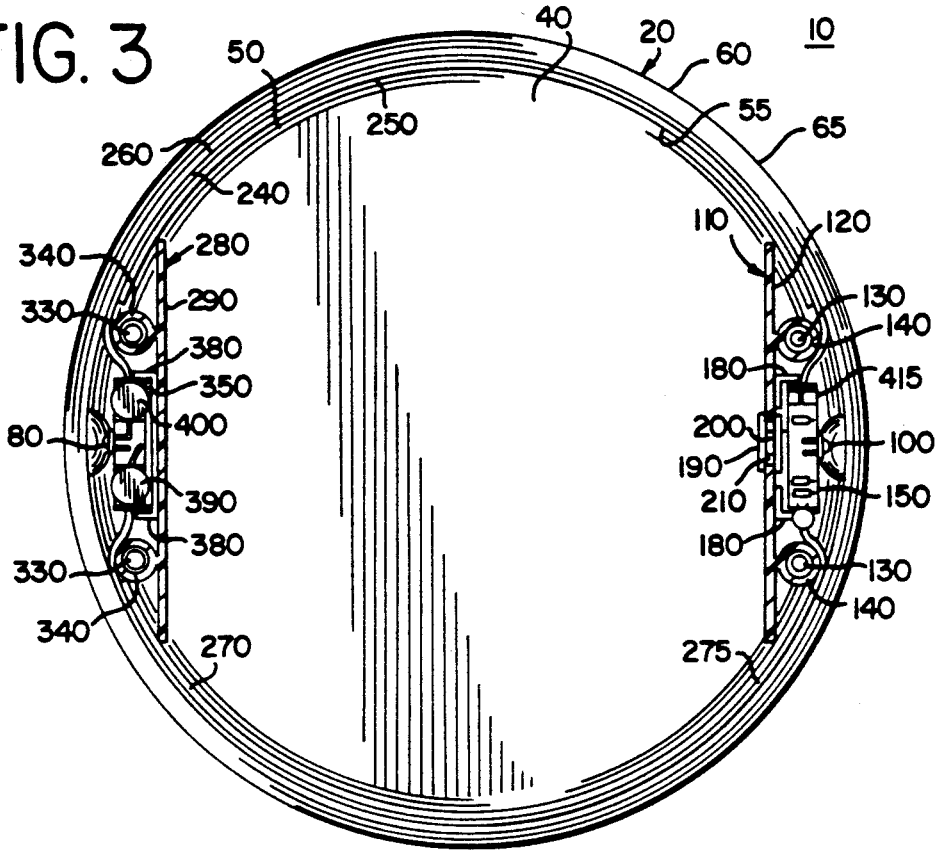
FIG. 3 is a bottom view of the preferred embodiment of the invention of FIG. 1.

FIG. 3 shows a bottom view of the preferred embodiment of the invention 10. The invention 10 consists of disk 20, having underside 40, perimeter 50, and lip 60. Lip 60 has inside surface 55 and outside surface 65. Also shown in FIG. 3 on disk 20 are cut-away views of switch housing 110 and battery housing 280. Battery housing 280 has battery housing cover 290. Also seen in FIG. 3 are battery circuit board 350, battery circuit board supports 380, first battery 390 and second battery 400, first light emitter 80, battery housing posts 330, and battery housing post receptacles 340.

Switch housing 110 has switch housing cover 120 with switch housing receptacles 140. Switch housing cover 120 has switch cavity 210. Also shown is switch circuit board 150 with components 416, second light emitter 100, switch housing posts 130, switch circuit board supports 180, switch 190 having switch guide 200. Also shown in FIG. 3 are first wire 240, second wire 260, and third wire 275, and first wire track 250, and second wire track 270.

Figure 4:
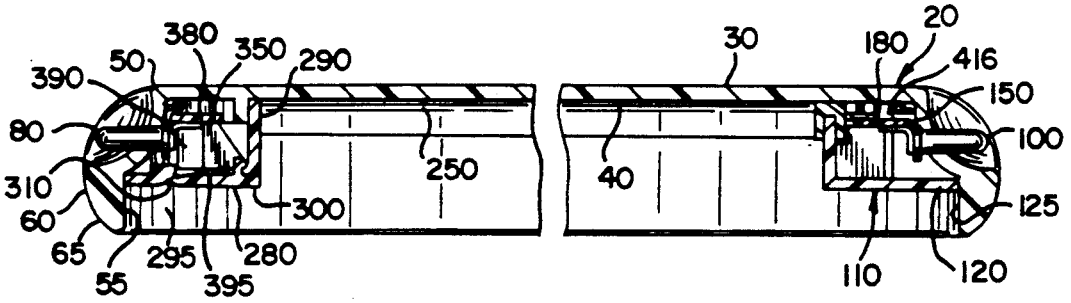
FIG. 4 is a side cross-sectional view of the preferred embodiment of the invention of FIG. 1.

FIG. 4 shows a side cross-sectional view of the preferred embodiment of the invention 10. The invention 10 consists of disk 20, having top 30, underside 40, perimeter 50, and lip 60. Lip 60 has inside surface 55 and outside surface 65. Also disposed on disk 20 are switch housing 110 and battery housing 280. Battery housing 280 has battery housing extension 295, battery housing cover 290, which has access 300, with living hinge 310, and spring conductor 395. Also seen in FIG. 4 are battery circuit board 350, battery circuit board supports 380, first battery 390, and first light emitter 80.

Switch housing 110 has switch housing cover 120 and switch housing extension 125. Also shown is switch circuit board 150 with components 416, second light emitter 100, switch circuit board supports 180. Also shown in FIG. 4 is first wire track 250.

Figure 5:
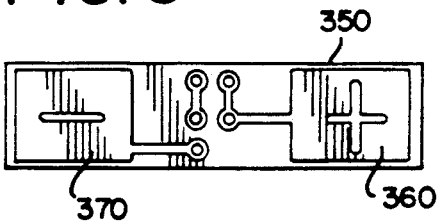
FIG. 5 is a top view of the battery circuit board of the preferred embodiment of the invention.
Figure 6:
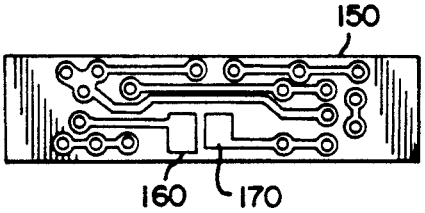
FIG. 6 is a bottom view of the switch circuit board of the preferred embodiment of the invention.

FIG. 5 is a top view of battery circuit board 350, having positive contact 360, and negative contact 370. FIG. 6 is a bottom view of switch circuit board 150, showing first contact pad 160 and second contact pad 170.

Figure 7:
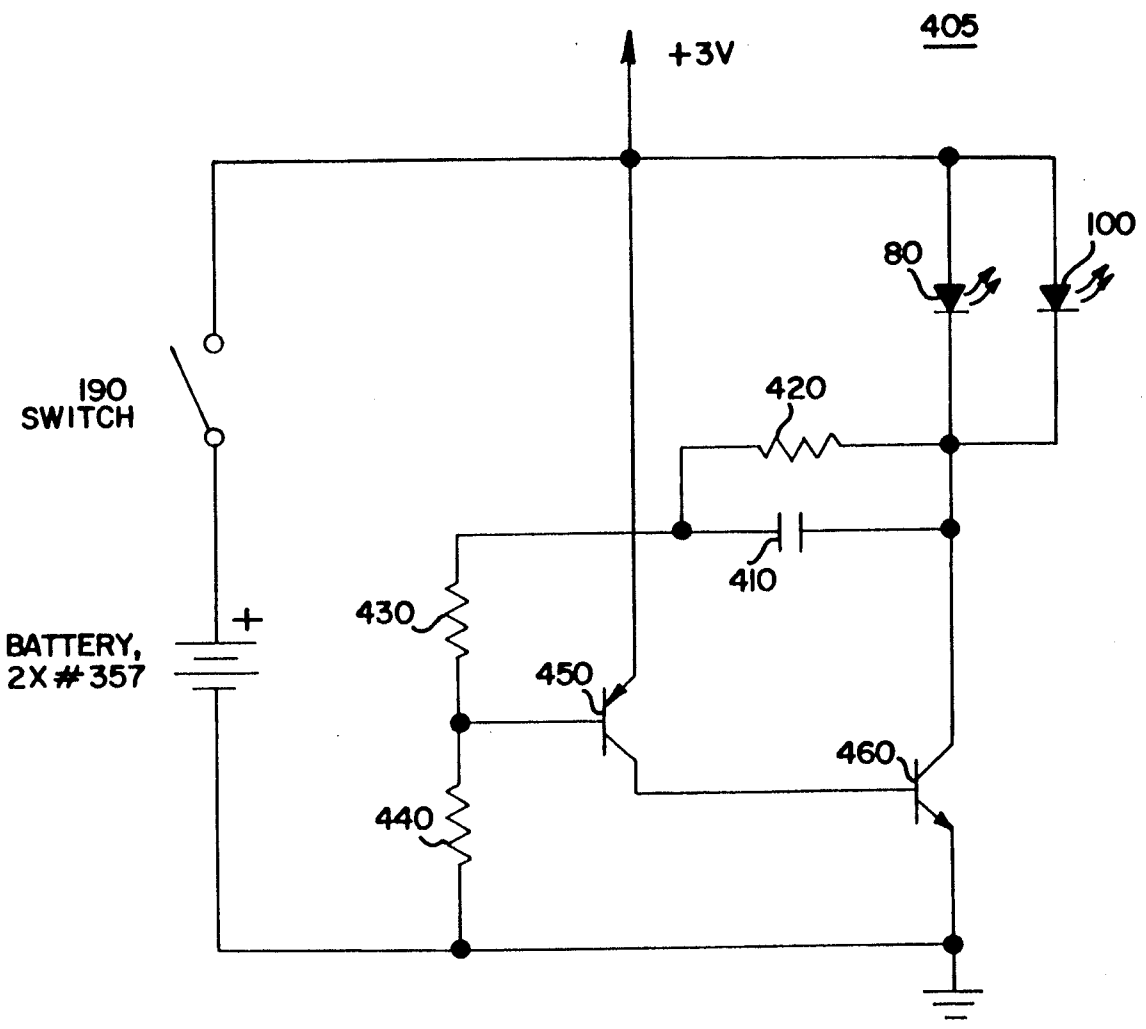
FIG. 7 is a circuit diagram of the control circuitry of the preferred embodiment of the invention.

FIG. 7 shows a schematic diagram of control circuitry 405. Control circuitry 405 is a fast pulse Schmitt trigger or relaxed oscillator which supplies the light emitters 80 and 100 with pulses of very short duration. The pulses have a short duty cycle, promoting extended battery life.

The control circuitry 405 activates when switch 190, is moved by an operator to the closed position. As shown in FIG. 2, eyelet spring 230 is placed around the body 225 of eyelet 220 and captured by switch 190. Eyelet spring 230 keeps the eyelet 220 in constant contact with the switch circuit board 150 by applying upward tension on the flange 235 of the eyelet 220. When the switch 190 is moved to the closed position by tracking along switch guide 200 in switch cavity 210, the eyelet 220 is in contact with and bridges first contact pad 160 and second contact pad 170 on switch circuit board 150. (See FIG. 6). This movement closes and completes the electrical circuit.

With the switch 190 closed, current flows to charge capacitor 410. When capacitor 410 reaches a predetermined charge level, insufficient voltage is across the light emitters 80 and 100 so that light emitters 80 and 100 no longer emit light. When the capacitor 410 has reached a sufficiently charged state, the voltage at the base of the first transistor 450, through the voltage divider network formed by first resistors 420, second resistor 430 and third resistor 440, causes first transistor 450 to switch to a conductive state. This causes second transistor 460 to likewise switch to a conductive state. The switching of first transistor 450 to a conductive state briefly effectively grounds the right terminal of the capacitor 410 to discharge some of the voltage across the capacitor 410. This simultaneously establishes a path to ground for the light emitters 80 and 100 so that the light emitters 80 and 100 are briefly lit. The discharge of the capacitor 410 lowers the voltage at the base of first transistor 450 sufficiently to turn both first transistor 450 and second transistor 460 to a non-conductive or off state.

By selection of the appropriate component values for the illustrated circuit, very short pulses of power are applied to the light emitters 80 and 100 to conserve battery life. Pulses in the radio frequency range are produced by the following circuit values: capacitor 410=0.068 uF.; first resistor 420=2.2M ohms; second resistor 430=22K ohms; third resistor 440=1.5M ohms; first transistor 450=2N3906; and second transistor=2N3904.

The foregoing specification describes only the preferred embodiment and the alternate embodiments of the invention as shown. Other embodiments may be articulated as well. The terms and expressions therefore serve only to describe the invention by example only and not to limit the invention. It is expected that others will perceive differences which while differing from the foregoing, do not depart from the spirit and scope of the invention herein described and claimed.

We claim:

1. An illuminated flying disk, comprising:

a disk having a perimeter, said disk further having a top and a bottom;

a lip disposed on said perimeter, said lip having an inside and outside;

an electronic housing and a switch housing symmetrically opposed on said disk at said lip, said electronic housing in electrical communication with said switch housing;

at least one light emitter mounted on said disk; and said light emitter illuminated by control circuitry having at least one battery disposed in said electronic housing and a switch disposed in said switch housing, said control circuitry further including a capacitor, at least one transistor and at least one resistor, said switch manipulated to cause illumination of said light emitter;

said battery with said electronic housing and said switch with said switch housing constructed to provide approximately equal mass to enable balanced spinning of said illuminated flying disk during spinning flight.

2. The illuminated flying disk of claim 1, wherein said at least one light emitter is disposed on the outside of said lip of said disk.

3. The illuminated flying disk of claim 1, wherein two light emitters are disposed on opposite sides of the outside of said lip.

4. The illuminated flying disk of claim 1, wherein said electronic housing has a living hinge.

5. The illuminated flying disk of claim 1, wherein said electronic housing has a slide-in cover.

6. The illuminated flying disk of claim 1, wherein said control circuitry is powered by two low current batteries disposed in said electronic housing.

7. The illuminated flying disk of claim 1, wherein said switch has an eyelet, and disposed within said switch housing is a switch circuit board having a first contact pad and a second contact pad, said eyelet enabling electrical communication between said first contact pad and said second contact pad when said switch is set in a closed position.

8. An illuminated flying disk, comprising:

a disk having a perimeter, said disk further having a top and a bottom;

a lip disposed on said perimeter, said lip having an inside and an outside;

an electronic housing and a switch housing oppositely opposed on said disk at said inside of said lip, said electronic housing in electrical communication with said switch housing;

at least one light emitter mounted on said disk; and said light emitter illuminated by control circuitry disposed with an electronic housing and a switch housing, said control circuitry comprised of a capacitor, at least one transistor and at least one resistor, said switch housing having a switch circuit board disposed therein, said switch circuit board including multiple contacts with a single moving bridge element, said single moving bridge element manipulated to cause illumination of said light emitter;

said battery with said electronic housing and said switch with said switch housing constructed to provide approximately equal mass to enable balanced spinning of said illuminated flying disk during spinning flight.

9. The illuminated flying disk of claim 8, wherein said at least one light emitter is disposed on the outside of said lip of said disk.

10. The illuminated flying disk of claim 8, wherein two light emitters are disposed on opposite sides of the outside of said lip.

11. The illuminated flying disk of claim 8, wherein said electronic housing has a living hinge.

12. The illuminated flying disk of claim 8, wherein said electronic housing has a slide-in cover.

13. The illuminated flying disk of claim 8, wherein said control circuitry is powered by two low current batteries disposed in said battery housing.

14. The illuminated flying disk of claim 8, wherein said single moving bridge element is a switch having an eyelet, said eyelet enabling electrical communication between said multiple contacts when said switch is set in a closed position.

15. An illuminated flying disk comprising:

a disk having a perimeter, a top, and a bottom;

a lip disposed on said perimeter, said lip having an inside and an outside;

a battery housing and a switch housing oppositely opposed on said bottom of said disk at said inside of said lip;

a wire track disposed on said bottom of said disk along said perimeter at said inside of said lip, said wire track receiving at least one wire for providing electronic communication between said battery housing and said switch housing;

at least one light emitter mounted on said disk; and control circuitry for illuminating said at least one light emitter, said control circuitry including a switch circuit board disposed in said switch housing, said switch circuit board having multiple contacts with a single moving bridge element, said single moving bridge element manipulated to cause illumination of said light emitter;

said battery housing and said switch housing constructed so that when a battery is in said battery housing approximately equal mass is provided to enable balanced spinning of said illuminated flying disk during spinning flight.

16. The illuminated flying disk of claim 15, wherein said control circuitry further includes a capacitor, at least one transistor and at least one resistor, said capacitor, transistor and resistor disposed on said switch circuit board.

17. The illuminated flying disk of claim 16, wherein said control circuitry further includes a battery circuit board disposed in said battery housing, said control circuitry is powered by at least one low current battery disposed in said battery housing on said battery circuit board.

18. The illuminated flying disk of claim 17, wherein said battery circuit board includes a first contact and a second contact each receiving a low current battery.

19. The illuminated flying disk of claim 15, wherein said single moving bridge element is a switch having an eyelet, said eyelet enabling electrical communication between said multiple contacts when said switch is set in a closed position.

20. The illuminated flying disk of claim 15, wherein two light emitters are disposed on said disk.

* * * * *